United States Patent [19]

Rigali

[11] 4,111,477

[45] Sep. 5, 1978

[54] WINDOW GUARD RELEASE

[76] Inventor: Paul D. Rigali, 711 N. Bush, Anaheim, Calif. 92805

[21] Appl. No.: 806,023

[22] Filed: Jun. 13, 1977

[51] Int. Cl.[2] ..... E05C 13/04

[52] U.S. Cl. ..... 292/252

[58] Field of Search ..... 292/DIG. 72, 252, 302; 49/56

[56] References Cited

U.S. PATENT DOCUMENTS

| | | | |
|---|---|---|---|
| 495,130 | 4/1893 | Flynn | 292/59 X |
| 3,027,188 | 3/1962 | Eichsladt | 292/38 X |
| 3,037,256 | 6/1962 | Chapman | 85/5 B X |
| 3,214,195 | 10/1965 | Zahuranec et al. | 85/5 B X |
| 3,921,334 | 11/1975 | Black, Sr. | 49/56 |
| 3,932,916 | 1/1976 | Baker | 85/5 B |
| 4,016,914 | 4/1977 | Zurko | 85/5 B |

*Primary Examiner*—Richard E. Moore

*Attorney, Agent, or Firm*—Knobbe, Martens, Olson, Hubbard & Bear

[57] ABSTRACT

A window guard release mechanism and method. A window guard is attached to a casement on hinges and a hole drilled through the adjacent wall. A quick release pin is inserted through the hole. A keeper is fixed to and aligned on the window guard to connect and lock to the release pin. A spring biases the keeper so that unlocking the release pin from the keeper, by pressing an attached activating button, causes the keeper to eject from the release pin, swinging the attached window guard open, providing quick access through the window without interference by the window guard.

5 Claims, 5 Drawing Figures

FIG. 4.
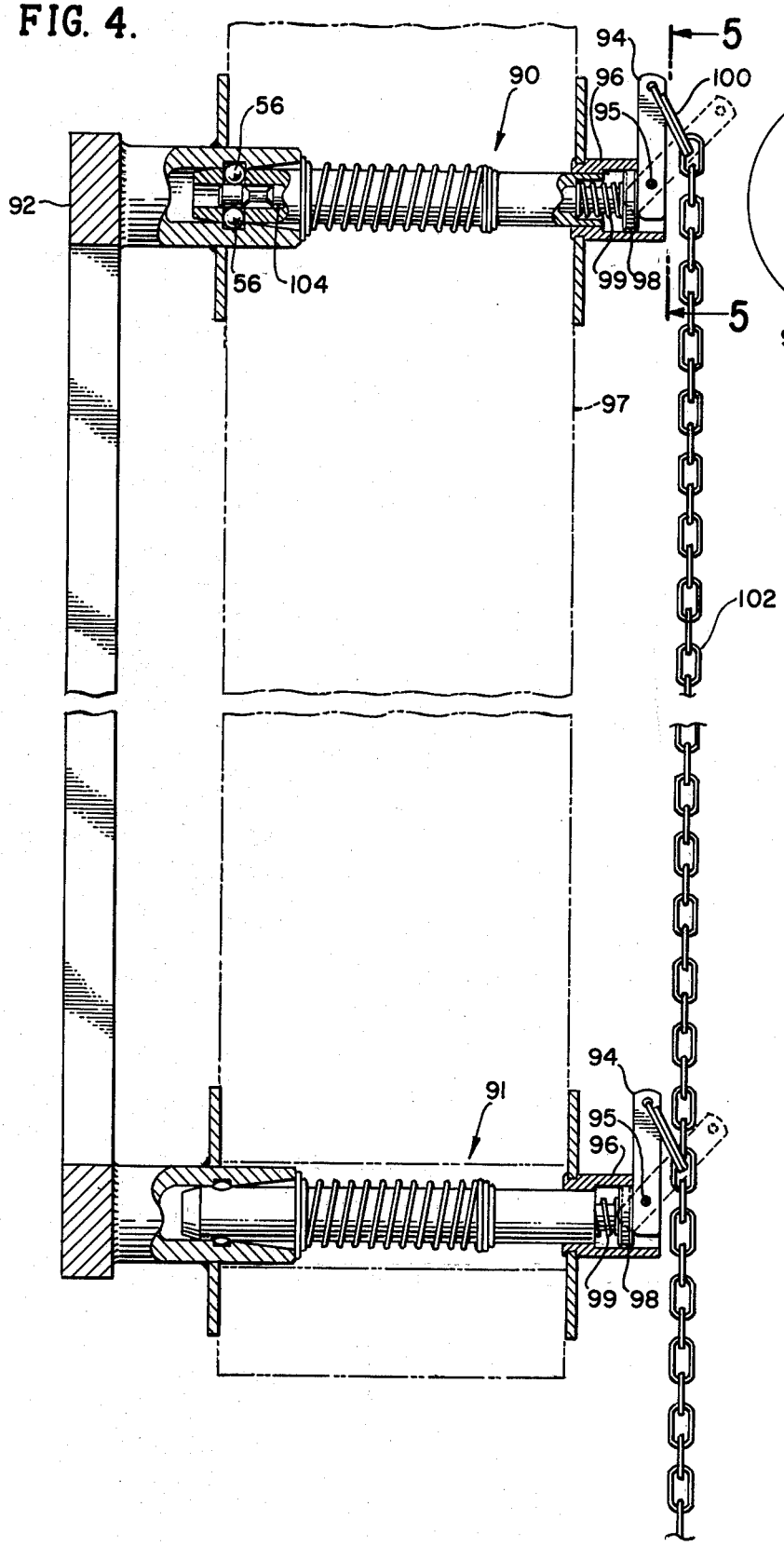
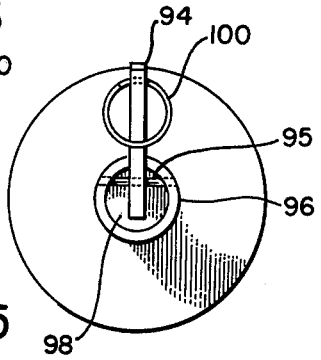
FIG. 5.

WINDOW GUARD RELEASE

BACKGROUND OF THE INVENTION

A common method of discouraging theft from a house or office is to install iron grill window guards and similar devices over windows and doors which cannot be penetrated by a potential thief. These metallic grills and guards cannot be broken as an ordinary window, and therefore provide considerably greater protection against theft. However, the installation of these protections has introduced a new problem in that, while they keep the thief out, they also, in the past, have kept the residents in. This problem has assumed major proportions, especially in homes where there are small children. In the event of a fire, particularly if the fire is in a hallway, or otherwise cuts off the passage to a door leading to the outside, young children, or even adults, may be trapped in a room from which the only exit is a window protected by an iron window guard or similar grill. In this event, the person inside the room can be fatally burned or fatally exposed to smoke inhalation unless a mechanism is available to open the window guard and allow the escape of the entrapped party.

If the escape mechanism is to have any practical value, it must meet all of the following requirements. First, it must keep the thief out. Secondly, the guard must be unopenable from the outside, while at the same time allow the party inside to release the guard and go out through the window if necessary. Finally, the system must be easily operated by a young child. The persons most often trapped in these buildings are young children, and a system which would be workable for an adult might be completely unworkable by a child.

Thus, a workable guard release seemingly has two contradictory requirements. It must first be one that is unopenable from the outside, while it must be easily openable from the inside, for even a child must be able to operate it with tremendous quickness in the case of an emergency. Accordingly, the invention disclosed herein has as its principal advantages the construction of a system which is quickly operable by children and adults from the inside of a house to release a window guard on the outside, while at the same time makes it a difficult task for a thief or other party on the outside to penetrate through the window guard into the house.

SUMMARY OF THE INVENTION

A window guard release system, quickly and easily operable by both adults and children, is disclosed. A window guard is attached to a window casement on hinges, so that it may swing open. A hole is drilled through the adjacent wall, and a tubular shank is inserted into the hole. The shank is then fixedly attached to the wall so it cannot move through the passage. A metal keeper is aligned with the shank on the window guard, and is welded in place. The keeper is then locked to the shank. A spring attached to the shank biases the keeper to eject from the shank upon unlocking the shank from the keeper. The keeper is conveniently unlocked from the shank by pressing a button inside the house, which releases the keeper allowing it to eject from the shank in response to the spring bias, thereby swinging the attached window guard open.

In the preferred embodiment, the shank is a part of a release pin of the type which employs locking balls which protrude through the exterior surface of a tubular shank. The locking balls are kept in their protruded locking position by riding on a slidable inner rod. The rod has formed on it a narrow spindle region; sliding the rod within the hollow shank to bring the narrower spindle in contact with the locking balls allows the balls to withdraw into the shank to an unlocked position.

The keeper, in the preferred embodiment, is a cylindrical metal body with a bore formed through it. The bore is tapered slightly so that it is larger on the end which the release pin enters, so the pin can easily be inserted. The release pin's locking balls seat inside an annular groove formed in the bore; the keeper is held to the release pin by contact between the locking balls and the shoulders formed by the groove.

A spring attached to the release pin presses against the keeper when the keeper is locked to the pin. Pressing a button on the release pin causes the spindle on the rod to move to the region of the locking balls, allowing them to withdraw into the shank, and freeing the keeper to move off the pin in response to the pressure from the spring. This then swings the window guard open.

Preferably, the keeper attaches to the release pin inside the house wall. A shielding washer is installed on the keeper where it enters the wall to prevent tampering with the assembly and to cover the hole where the keeper enters to improve the appearance of the system when installed.

In an alternate arrangement, a release pin is operable by a chain. This enables a pin to be situated near the bottom of the window and a second release pin to be located near the top of the window. The two pins are operable by a chain hanging from the lower pin so that it is easy for a child to reach. Using two pins is desirable for large window guards.

DESCRIPTION OF THE DRAWINGS

FIG. 4 is an elevational, partially sectionalised view of a second embodiment; and FIG. 5 is a view on line 5—5 of FIG. 4.

DETAILED DESCRIPTION OF THE PREFERRED EMBODIMENT

Figure 1:
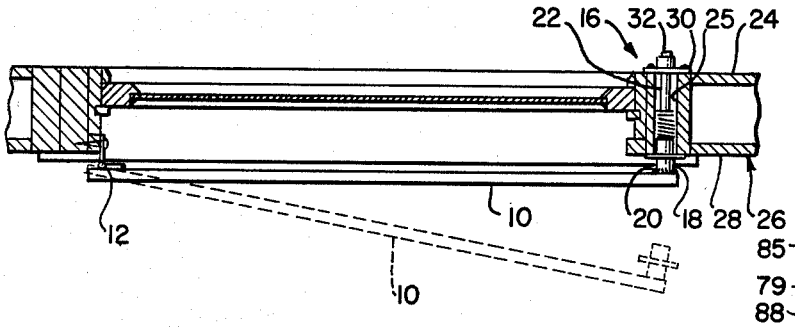
FIG. 1 is a sectional view through a wall showing the preferred embodiment attached to a window casement.

Turning to FIG. 1, a typical window guard 10 is held to the wall on one side by hinges 12. At the other side of the window casement from the hinges, attached to the wall, is a locking and release system 16. This sytem comprises a keeper 18 which is attached to the window guard 10 by weld 20 and the quick release locking pin assembly 22. The release pin assembly extends from the interior side 24 of the wall 26 through passage 25 in wall 26 to the keeper 18, which extends from the window guard 10 through the outer side 28 of the wall 26 to meet the release pin assembly 22. It should be understood that by interior side 24, it is meant that side of the wall 26 from which it is desired to activate the release mechanism to free the window guard 10; the interior side 24 will normally be the interior of a house or building, but it could also be a side of an outdoor guard gate which is desired to be locked according to the present invention. Similarly, outer side 28 of wall 26 will refer to that side of the wall 26 which faces the window guard 10, that is, the part of the wall which will normally face the outside of the house or building. The release pin assembly 22 attaches to the keeper 18 in a fashion which will be described in detail below. The details of the attachment and alignment of member 18 will also be discussed below.

On the interior side 24 of the wall 26, the release pin assembly 22 is attached to the wall 26 by use of plate 30. Also protruding away from the wall 26 is a small button 32 used to release the window guard 10 in a fashion to be discussed. With this overall view of the placements of the components to the instant invention, a detailed description can be readily understood.

Figure 2:
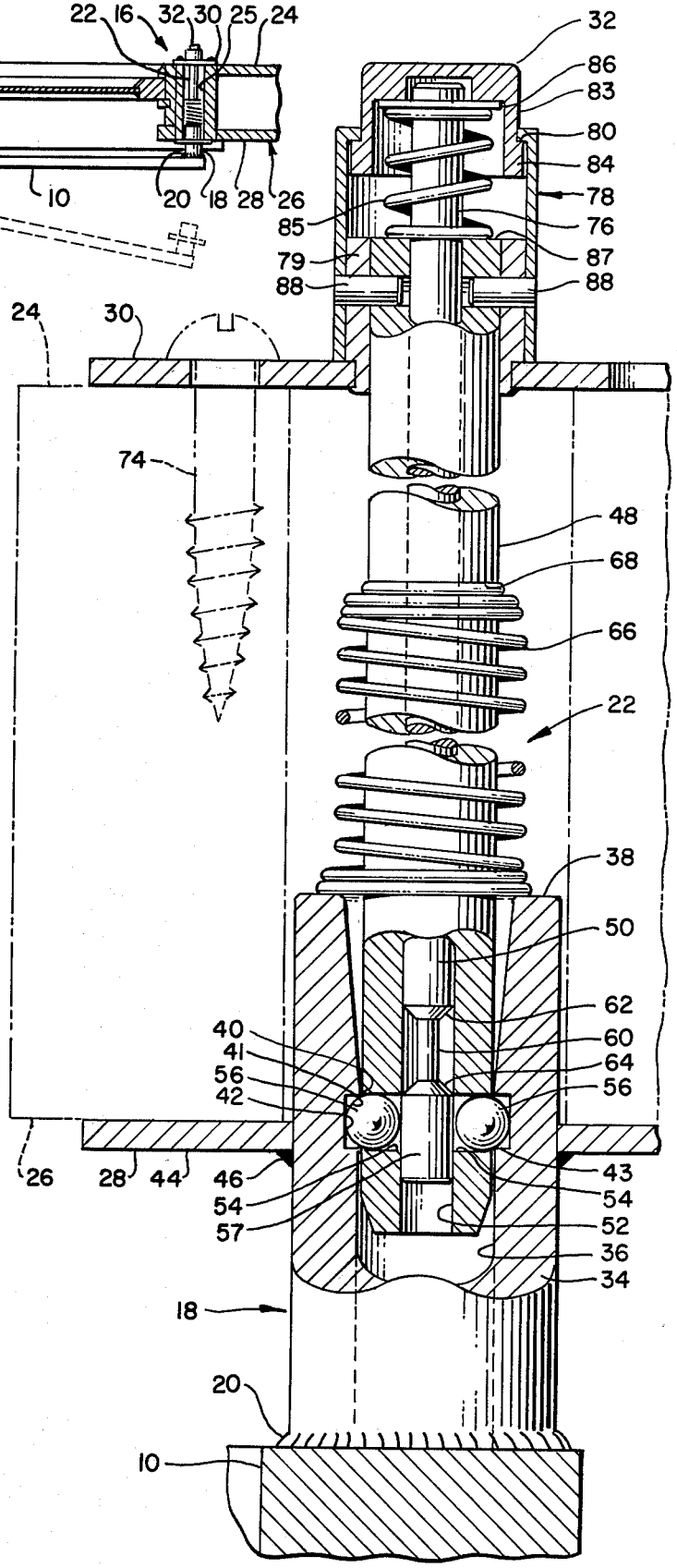
FIG. 2 is a fragmentary section showing the locked position.

Turning to FIG. 2, the keeper 18 is attached to the window guard 10, by a suitable weld 20. The keeper 18 has a tubular wall 34 made from durable, tough material, such as steel, so that a potential burgular could not easily cut or break it. On the end 38 of the keeper 18 pointing toward the interior side 24, the bore 36 through the keeper 18 tapers slightly so that it has wider diameter at its end 38 than at an inner point 40. In the preferred embodiment, the outer diameter of keeper wall 34 remains constant. Thus, the keeper wall 34 is slightly thinner at the face 38 where it terminates inside the wall of the house then it is at the interior point 40 on the bore 36 formed by the cylindrical wall 34. Outwardly from but aligned to the interior point 40, the keeper 18 has formed within it an annular groove 42, or other means to widen the bore 36, to form a support shoulder 41 facing away from the tapered section of bore 36, that is, toward the outside. Additionally, secured to the keeper 18, is a shielding washer 44 welded to the outside of keeper 18 by a suitable weld 46. The method and timing of the attachment of this shielding washer will be discussed when the final assembly and operation of the invention is discussed.

The release pin assembly 22 has an outer tubular cylindrical shank 48 surrounding a rod 50 which is small enough in diameter to slide easily through the inner cylindrical bore 52 formed in the shank 48. The outer diameter of shank 48 is made slightly smaller than the diameter of the bore 36 of keeper 18 so that it may slip through and fit within bore 36 of keeper 18. Near the end of shank 48, where it fits into the keeper 18, there are formed apertures 54 which extend between the bore 52 of the shank 48 and the outside of the shank 48. Fitted within the apertures are metal balls 56 which have a diameter slightly smaller than the diameter of the aperture 54. The circumference 58 of the apertures 54, at the outer surface of shank 48 is slightly smaller than the diameter of the balls 56 so that a substantial portion of the balls 56 can protrude beyond the surface of the shank 48, without allowing the balls 56 to fall out of the shank 48. The annular groove 42 in the keeper 18, and the balls 56 are dimensioned such that the balls 56 may fit easily within the groove 42. Preferably, the groove 42 is large enough to allow for the maximum protrusion of the balls 56 from the shank 48. In the locked position, as shown in FIG. 2, the balls 56 are firmly held in the groove 42 by riding on the section 57 of rod 50 which has a diameter only slightly smaller than the bore 52. The rod 50 is made from a solid, relatively incompressible material, so that the balls 56 cannot be pushed in when riding on its surface.

Also, at the end of the release pin assembly 22 which fits into the keeper 18, the rod 50 has a spindle section 60 which is of a smaller diameter than the section 57 of rod 50. The shoulders 62 and 64 that connect this smaller diameter spindle 60 with the outer circumference of rod 50, are sloped to provide an area where the diameter of the rod 50 gradually increases.

Surrounding a portion of shank 48 is a coil spring 66 having its inner end attached to an annular groove 68 in the shank 48 located between the interior side 24 of wall 26 and the keeper 18. The location of the groove 68 is selected so that when the outer end of the pin assembly 22 is inserted into the keeper 18, the spring is compressed and presses against the end 38 of the keeper 18.

The shank 48 terminates at a conveniently small distance on the interior side 24 of the wall 26. The rod 50 has a section 76 which extends beyond the end of the shank 48, that is, beyond the end of bore 52 into the inside of the house. A small tubular housing 78 attached to the shank 48, surrounds the end of assembly 22 inside the house. More specifically, a tubular sleeve 79 surrounds the end of the shank 48, and the housing 78 surrounds the sleeve. The sleeve and the housing are attached to the shank 48 by a pair of pins 88 which extend radially through the housing and sleeve and into holes in the shank 48. Attached to the inner end of the sleeve 79 is a metal plate 30 used to attach the release pin assembly to the inside wall 24. In the preferred embodiment, a plurality of holes is drilled through the plate 30 and the mechanism 22 is firmly attached to the wall 24 by screws 74.

Fitted within the housing 78 is a small button 32 having an upper section 83 which protrudes from the end of the housing 78 and has a larger diameter section 84 which fits within the housing 78 and has a diameter wider than a shoulder 80 of housing 78. The button 32 caps the end of the rod 50. Engaging the end face 87 of the shank 48 is a small coil spring 85 which on its other end, engages a washer 86 surrounding the rod 50 and transmitting force to the button 32. This spring is selected so that in a normal position, the button 32 is biased outwardly with the button section 84 urged against the shoulder 80 of the end housings. The rod 50 is thus held in a position where the locking balls 56 will ride on the wide part of rod 50, that is, on section 51 of rod 50.

Considering the operation of the invention, FIG. 2 shows the apparatus in its locked position. A burglar, or other person desiring to gain illicit entry into the house, is prevented by the window guard 10 placed outside of the window. An attempt to pull the guard 10 from the window is prevented by the balls 56 which protrude into the keeper 18, and hold the keeper 18 to the shank 48 which is firmly attached to the inside wall of the house. In other words, an attempt to pull the guard 10 away from the window, because of the balls 56 seating in the groove 42, will be stopped by the balls 56 contacting the shoulder 40. The groove 42 is used in the preferred embodiment so that the additional shoulder 43 contacting the balls 56 will prevent motion of the guard toward the house, as well as its removal away from the wall 26. Thus, this mechanism provides a very satisfactory method of securing the window guard 10 to the house. It should be noted that the wall 34 of the keeper 18 was constructed of a material such that it cannot be easily cut or broken, and that this was securely welded to the window guard 10, making it difficult to remove. In addition, the washer 44 prevents the burglar from tampering with the locking mechanism inside the wall 26, as well as cosmetically covering the hole where the keeper 18 enters the wall 26.

Figure 3:
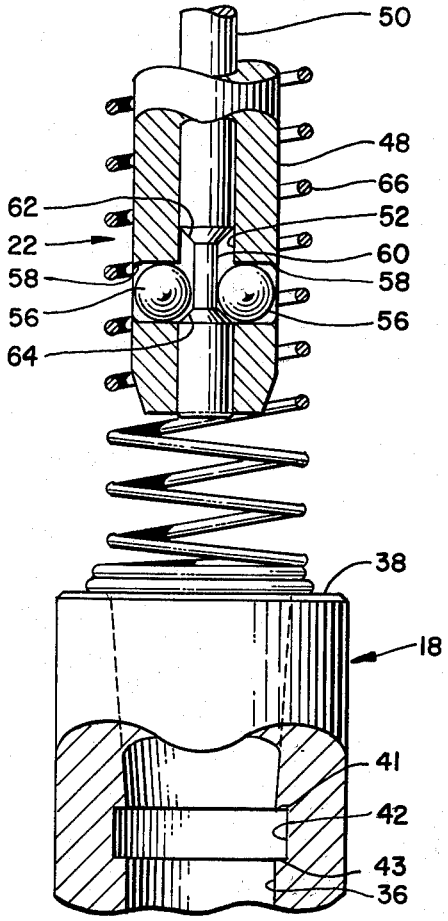
FIG. 3 is a section showing the unlocked position.

However, in the event of fire, or similar emergency in a house, this mechanism provides for a very rapid release of the guard 10 from the inside of the house, that is, the interior side 24 of the wall. The person desiring to exit from the house merely pushes on the button 32. Pushing the button 32 causes the rod 50 to slide forward. Referring now to FIG. 3, it can be seen that as the rod 50 slides forward, the spindle section 60 of rod 50, which has a smaller diameter than the rest of rod 50, comes in contact with the balls 56. The balls 56 are then free to move to position where they are not in contact with the shoulder 41 of keeper 18, but rather lay wholly within the walls of the shank 48. The spring 66, which was compressed, biased the keeper 18 in a direction away from the wall 26, then ejects the keeper 18 off the release pin assembly 22, and swings the attached window guard 10 on its hinges to an open position, providing for complete access to the window from the inside. Thus a very quick and rapid escape from the house can be accomplished through the window.

The release system is easily installed on the house. After the window guard is installed on its hinges, the passage 25 is drilled to allow the release pin assembly 22 to pass through the wall. In the preferred embodiment a hole of approximately 1 inch diameter is sufficient. The assembly 22 is then attached to the inside wall of the house. The locking keeper 18 is then aligned on the window guard 10 with the release pin assembly 22. The keeper 18 is welded to the window guard with the tapered section pointing towards the escape side 24 of the wall 26. The use of the taper allows the pin assembly 22 to be easily fitted into the keeper 18, and avoids requiring a highly precise alignment of the keeper 18 with the pin assembly 22. After aligning and welding the keeper 18 to the window guard, the keeper 18 is attached to the release pin assembly 22. This is easily accomplished by holding down button 32 and sliding the mechanism 24 into the keeper 18. The button 32 is then released and the rod 50 moved back the bore 36 until the balls 56 reach the groove 42. The sloping of the shoulder 64 will then roll the balls 56 up to the outer part of rod 50 into groove 42 as the rod 50 retracts along the inside of the bore 52, thus locking the release pin assembly 22 to the keeper 18.

In the preferred embodiment, prior to attaching the release pin 22 to the keeper 18, the shielding washer 44 is fitted over the keeper 18 so that it can be welded onto the keeper 18 after locking. After the window guard is locked in place, the washer is slid until it abuts the wall 26, and the washer 44 is welded in place.

Referring now to FIG. 4, there is shown a pair of release pin assemblies 90 and 91, one located near the upper end of a window guard 92 and the other located at the lower end of the guard. Two pins are desired in some cases because of the size of the guard. Each assembly is provided with an opening lever 94 which is pivotally mounted on a small shaft 95 extending transversely through the tubular housing 96 mounted on the wall 97 on the opposite side of the wall from the guard 92. The pivot shaft 95 is located adjacent the outer side of a disc 98 which is urged outwardly by the spring 99. The spring and disc normally hold the lever 94 in the vertical position shown in solid lines in the drawing wherein the release pins are locked to the window guard.

A ring 100 extends through the upper end of each lever 94, and the rings are linked to a chain 102 which also extends below the lower assembly 91. To release the pins, it is only necessary to pull on the lower end of the chain. This causes both levers 94 to pivot to their dotted line positions so that the lower end of each lever depresses the disc 98 to release the locking pin 104, as in the arrangement of FIGS. 1–3. Thus, even a small child can quickly release the window guard. The chain and pivoted lever approach is, of course, useful when only a single release pin is used but it is fairly high above the floor.

What is claimed is:

1. A window guard system for securing a window guard to an adjacent wall while simultaneously providing for quick release from said wall comprising:

a window guard movably mounted on said wall between a closed position covering a window in said wall and an open position not covering the window;

a keeper attached to said window guard, said keeper having a bore therein opening towards said wall, and said keeper extending into said wall;

a flat plate-like shield firmly attached to and surrounding said keeper and engaging said wall, when said guard is in said closed position, to prevent access to the interior of the wall;

a pin fixed to said adjacent wall and extending at least partially through said wall and into the bore in said keeper;

means for releasably locking said pin within the bore of said keeper; and means connected to said pin and located on the interior of said wall for releasing said keeper from locking engagement with said locking pin.

2. A window guard system for securing a window guard to an adjacent wall while simultaneously providing for quick release from said wall comprising:

a window guard;

a keeper attached to said window guard;

a pin fixed to said adjacent wall and extending at least partially through said wall to engage said keeper;

means for releasably locking said pin to said keeper; and means connected to said pin and located on the interior side of said wall for releasing said keeper from locking engagement with said locking pin, said release means including actuating means extending below the level of said pin a substantial amount for releasing the pin from a point substantially below the level of the pin.

3. The system of claim 2 wherein said means on the interior side of said wall for releasing said keeper includes a pivotally mounted lever operable by a chain depending from the lever to move said pin to release it from the keeper.

4. The system of claim 3 wherein said pin and keeper are located near the top of said guard, and including a second keeper, pin and release means located near the lower end of the guard, said chain being connected to release both pins.

5. The system of claim 2 wherein said pin and keeper are located near the top of said guard, and including a second keeper, pin and release means located near the lower end of the guard, said actuating means being connected to release both pins.

* * * * *